US012127622B2

(12) United States Patent
McDermott

(10) Patent No.: US 12,127,622 B2
(45) Date of Patent: Oct. 29, 2024

(54) DUAL-SHELL HELMET

(71) Applicant: Baptist Health South Florida, Inc., Coral Gables, FL (US)

(72) Inventor: Michael W. McDermott, Pinecrest, FL (US)

(73) Assignee: Baptist Health South Florida, Inc., Coral Gables, FL (US)

( * ) Notice: Subject to any disclaimer, the term of this patent is extended or adjusted under 35 U.S.C. 154(b) by 109 days.

(21) Appl. No.: 17/509,427

(22) Filed: Oct. 25, 2021

(65) Prior Publication Data

US 2022/0125148 A1 Apr. 28, 2022

Related U.S. Application Data

(60) Provisional application No. 63/105,500, filed on Oct. 26, 2020.

(51) Int. Cl.
*A42B 3/06* (2006.01)

(52) U.S. Cl.
CPC ..... *A42B 3/069* (2013.01)

(58) Field of Classification Search
CPC ..... A42B 3/069; A42B 3/122; A42B 3/06; A42B 3/121; A42B 3/10; A42B 3/16; A42B 3/064; A42B 3/063; A42B 3/062
See application file for complete search history.

(56) References Cited

U.S. PATENT DOCUMENTS

| | | | | |
|---|---|---|---|---|
| 3,854,146 | A * | 12/1974 | Dunning | A42B 3/20 2/9 |
| 4,566,137 | A | 1/1986 | Gooding | |
| 5,083,320 | A * | 1/1992 | Halstead | A42B 3/122 2/413 |
| 5,204,998 | A | 4/1993 | Liu | |
| 6,226,801 | B1 | 5/2001 | Alexander et al. | |
| 6,378,140 | B1 | 4/2002 | Abraham et al. | |
| 8,756,719 | B2 * | 6/2014 | Veazie | A42B 3/064 267/114 |
| 9,549,582 | B2 | 1/2017 | Phipps et al. | |
| 9,648,920 | B1 * | 5/2017 | Kuntz | A42B 3/20 |
| 9,661,890 | B2 | 5/2017 | Weatherby et al. | |
| 9,868,046 | B2 | 1/2018 | Weatherby et al. | |

(Continued)

FOREIGN PATENT DOCUMENTS

WO 2020069497 A1 4/2020

*Primary Examiner* — Khoa D Huynh
*Assistant Examiner* — Uyen T Nguyen
(74) *Attorney, Agent, or Firm* — The Webb Law Firm

(57) ABSTRACT

A helmet, such as a football helmet, includes a shell portion, a retention assembly, and a face guard assembly. The shell portion includes: an outer shell; an inner shell spaced apart from the outer shell, the inner shell and the outer shell defining an interior space between the inner shell and the outer shell; at least one fastener assembly extending from the outer shell to the inner shell through the interior space; and at least one inflated bladder positioned in the interior space defined by the inner shell and the outer shell. The shell(s) can be formed from lightweight materials, such as carbon fiber. The retention assembly is connected to the inner shell for securing the helmet to a head of a wearer. The face guard assembly is connected to the outer shell and is positioned to protect at least a portion of a face of the wearer.

21 Claims, 5 Drawing Sheets

(56) References Cited

U.S. PATENT DOCUMENTS

| | | | | |
|---|---|---|---|---|
| 9,918,507 | B2 | 3/2018 | Eaton | |
| 10,004,973 | B2 | 6/2018 | Weatherby et al. | |
| 10,264,841 | B2 | 4/2019 | Linares et al. | |
| 10,448,691 | B2 | 10/2019 | Princip et al. | |
| 10,791,785 | B2 * | 10/2020 | Kuntz | A42B 3/0473 |
| 2012/0233745 | A1 * | 9/2012 | Veazie | A42B 3/125 2/413 |
| 2014/0223641 | A1 * | 8/2014 | Henderson | A42B 3/065 2/411 |
| 2015/0047109 | A1 * | 2/2015 | Grant | A42B 3/125 2/410 |
| 2015/0223547 | A1 * | 8/2015 | Wibby | A42B 3/064 2/414 |
| 2016/0088884 | A1 * | 3/2016 | Guerra | A63B 71/1225 2/455 |
| 2017/0105470 | A1 * | 4/2017 | Eaton | A42B 3/064 |
| 2017/0112220 | A1 * | 4/2017 | Suddaby | A42B 3/283 |
| 2017/0232327 | A1 * | 8/2017 | Kuntz | A42B 3/125 2/413 |
| 2018/0056168 | A1 * | 3/2018 | Sodec, Jr. | A42B 3/064 |
| 2018/0228239 | A1 * | 8/2018 | Day | F16F 1/126 |
| 2018/0295921 | A1 | 10/2018 | Princip et al. | |
| 2019/0029352 | A1 * | 1/2019 | Sadegh | A42B 3/12 |
| 2019/0029353 | A1 | 1/2019 | Ogata | |
| 2019/0133235 | A1 | 5/2019 | Domanskis et al. | |
| 2019/0297985 | A1 * | 10/2019 | Weber | A42B 3/064 |
| 2019/0307201 | A1 * | 10/2019 | Neal | A42B 3/20 |
| 2019/0328073 | A1 * | 10/2019 | Morgan | A42B 3/124 |
| 2020/0205506 | A1 | 7/2020 | Bologna et al. | |
| 2021/0282488 | A1 * | 9/2021 | Vito | A42B 3/064 |

* cited by examiner

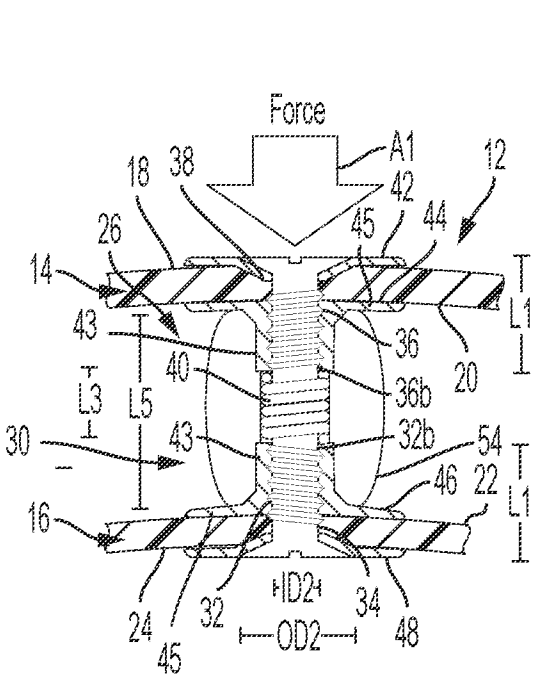
FIG. 4C
FIG. 4B
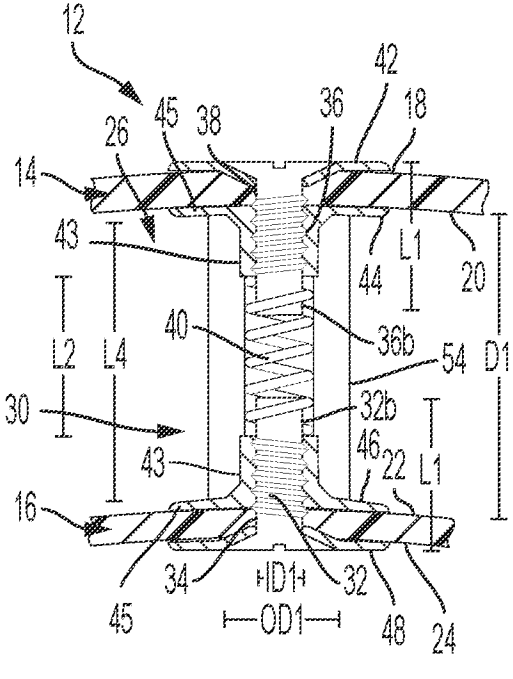
FIG. 4A

DUAL-SHELL HELMET

CROSS REFERENCE TO RELATED APPLICATION

The present application claims the benefit of U.S. Provisional Patent Application No. 63/105,500, filed Oct. 26, 2020, the disclosure of which is hereby incorporated by reference in its entirety.

BACKGROUND

Technical Field

This disclosure is directed to a protective helmet, such as a helmet for football and/or for other sports or activities, and, in particular, to a helmet comprising a shell portion formed from an inner shell, an outer shell, and at least one inflatable bladder positioned between the shells.

Technical Description

Helmets for football and other sports or activities comprising rigid shells formed from plastics and other composite materials and interior padded portions or liners are well known and widely used for sports and similar activities to protect a wearer's head. In recent years, designers have increasingly recognized the importance of providing helmets to protect a wearer from contacts and collisions that cause asymptomatic subconcussive injuries which, while not causing immediately identifiable symptoms, can cause progressive degenerative conditions (e.g., Chronic Traumatic Encephalopathy (CTE)). Helmets are also designed to protect wearers from more severe contacts and collisions that are known to cause concussions, skull fractures, traumatic brain injuries, and related head injuries having immediately identifiable symptoms. Football helmets designed to provide protection against subconcussive injuries as well as more severe head injuries are manufactured by a number of companies including Schutt Sports Manufacturing Co., Riddell Sports Group Inc., and Xenith LLC.

An exemplary football helmet is disclosed in U.S. Pat. No. 10,264,841, entitled "Helmet for attenuating impact event" which discloses a helmet including a rigid layer generally conforming to the wearer's head and force absorbing and reacting portions extending from locations of the rigid layer. The force absorbing and reacting portion can comprise inner and intermediate cushioning rings configured to extend about a periphery of the skull. The cushioning rings can be formed, for example, from compressible gels or foams.

Another exemplary football helmet is disclosed in U.S. Pat. No. 8,756,719, entitled "Method and apparatus for an adaptive impact absorbing helmet system," which discloses a dual shell helmet comprising an outer shell and a second more rigid inner shell. The shells are separated by compartmentalized sealed elastomer energy absorbing cells. The cells can contain a gas or liquid agent that absorbs force energy applied to the shells.

Another exemplary football helmet including multiple rigid layers or shells is disclosed in U.S. Pat. No. 10,448,691, entitled "Football helmet with movable flexible section". An inner shell of the helmet is a single rigid shell configured to partially enclose the wearer's head. The outer shell comprises multiple separate panels attached to different portions of the inner shell. The inner shell and the outer shell are separated by an energy absorbing layer comprising individual air or gel cells.

An exemplary liner for a helmet is disclosed in U.S. Pat. No. 6,226,801, entitled "Football helmet having a removable inflatable liner and a method for making the same." The inflatable liner includes multiple inflatable cells that are arranged to form a central ring, configured to be positioned over the crown of the wearer's head, and a plurality of loops extending from the central ring for protecting other portions of the wearer's skull. The inflatable liner is sized to be inserted within a conventional football helmet for providing additional impact protection for the wearer's head.

SUMMARY

In accordance with an example of the present disclosure, an exemplary helmet comprises a shell portion, a retention assembly, and a face guard assembly. The shell portion comprises: an outer shell; an inner shell spaced apart from the outer shell, the inner shell and the outer shell defining an interior space between the inner shell and the outer shell; at least one fastener assembly extending from the outer shell to the inner shell through the interior space; and at least one inflated bladder positioned in the interior space defined by the inner shell and the outer shell. The retention assembly is connected to the inner shell for securing the helmet to a head of a wearer. The face guard assembly is connected to the outer shell and is positioned to protect at least a portion of a face of the wearer.

Another exemplary helmet comprises a shell portion and an interior padding portion. The shell portion comprises: an outer shell; an inner shell spaced apart from the outer shell, the inner shell and the outer shell defining an interior space between the inner shell and the outer shell; at least one fastener assembly extending from the outer shell to the inner shell through the interior space; and at least one inflated bladder positioned in the interior space defined by the inner shell and the outer shell. The interior padding portion is connected to and extends from an inwardly facing surface of the inner shell. The interior padding portion defines an enclosure for receiving at least a portion of a head of a wearer.

In accordance with another example of the disclosure, a football helmet comprises a shell portion, a strap, and a face mask. The shell portion comprises: an outer shell; an inner shell spaced apart from the outer shell, the inner shell and the outer shell defining an interior space; at least one fastener assembly extending from the outer shell to the inner shell through the interior space; and at least one inflated bladder positioned in the interior space defined by the inner shell and the outer shell. The strap is connected to the inner shell for securing the helmet to a head of a wearer. The face mask is connected to the outer shell and is positioned to protect at least a portion of a face of the wearer.

Further non-limiting examples are set forth in the following numbered clauses.

Clause 1: A helmet comprising: a shell portion comprising: an outer shell; an inner shell spaced apart from the outer shell, the inner shell and the outer shell defining an interior space between the inner shell and the outer shell; at least one fastener assembly extending from the outer shell to the inner shell through the interior space; and at least one inflated bladder positioned in the interior space defined by the inner shell and the outer shell; a retention assembly connected to the inner shell for securing the helmet to a head of a wearer; and a face guard assembly connected to the outer shell positioned to protect at least a portion of a face of the wearer.

Clause 2: The helmet of clause 1, wherein the helmet comprises a football helmet.

Clause 3: The helmet of clause 1 or clause 2, wherein the retention assembly comprises a chin strap.

Clause 4: The helmet of any of clauses 1-3, wherein the retention assembly is connected to an outwardly facing surface of the inner shell by at least one of a snap, a fastener, or a screw.

Clause 5: The helmet of any of clauses 1-4, wherein the face guard assembly comprises at least one of a mask, a shield, a cage, or a crossbar.

Clause 6: The helmet of any of clauses 1-5, wherein the face guard assembly is connected to an outwardly facing surface of the outer shell by one or more of a fastener or screw.

Clause 7: The helmet of any of clauses 1-6, wherein the inner shell and/or the outer shell are formed from polycarbonate.

Clause 8: The helmet of any of clauses 1-6, wherein the inner shell and/or the outer shell comprise a composite carbon fiber material.

Clause 9: The helmet of any of clauses 1-8, wherein the fastener assembly comprises: an inner fastener inserted through an opening in the inner shell, an outer fastener inserted through an opening in the outer shell, and a resilient member extending between an end portion of the inner fastener and an end portion of the outer fastener.

Clause 10: The helmet of clause 9, wherein the fastener assembly further comprises annular collars connected to the inner and outer shells for supporting the fasteners.

Clause 11: The helmet of clause 9, wherein the fastener assembly further comprises: a first outer annular collar connected to an outwardly facing surface of the outer shell, a second outer annular collar connected to an inwardly facing surface of the outer shell, a first inner annular collar connected to an inwardly facing surface of the inner shell, and a second inner annular collar connected to the outwardly facing surface of the inner shell.

Clause 12: The helmet of clause 11, wherein the inner fastener is inserted through openings defined by the first and second inner annular collars, and the outer fastener is inserted through openings defined by the first and second outer annular collars.

Clause 13: The helmet of any of clauses 10-12, wherein the collars comprise a body portion configured to receive the fastener and a flange portion extending about the body.

Clause 14: The helmet of any of clauses 9-13, wherein the inner fastener comprises an inner screw and the outer fastener comprises an outer screw.

Clause 15: The helmet of any of clauses 9-14, wherein the fastener assembly further comprises a sleeve extending around at least portions of the fasteners and the resilient member.

Clause 16: The helmet of clause 15, wherein the sleeve comprises an elastomeric material.

Clause 17: The helmet of any of clauses 9-15, wherein the resilient member comprises a coil spring.

Clause 18: The helmet of any of clauses 1-17, wherein the at least one inflated bladder comprises a plurality of inflated bladders connected by tubular conduits.

Clause 19: The helmet of any of clauses 1-18, further comprising an interior padding portion connected to and extending from an inwardly facing surface of the inner shell, the interior padding portion defining an enclosure for receiving at least a portion of the wearer's head.

Clause 20: The helmet of clause 19, wherein the interior padding portion comprises at least one inflatable cushion, the helmet further comprising a nozzle extending through openings in the outer shell and the inner shell for filling the at least one inflatable cushion of the interior padding portion.

Clause 21: The helmet of clause 19, wherein the interior padding portion comprises a plurality of inflatable cushions fluidly connected together, the helmet further comprising a nozzle extending through openings in the outer shell and the inner shell for filling each of the plurality of inflatable cushions of the interior padding portion through the nozzle.

Clause 22: A helmet comprising: a shell portion comprising: an outer shell; an inner shell spaced apart from the outer shell, the inner shell and the outer shell defining an interior space between the inner shell and the outer shell; at least one fastener assembly extending from the outer shell to the inner shell through the interior space; and at least one inflated bladder positioned in the interior space defined by the inner shell and the outer shell; and an interior padding portion connected to and extending from an inwardly facing surface of the inner shell, the interior padding portion defining an enclosure for receiving at least a portion of a head of a wearer.

Clause 23: The helmet of clause 22, wherein the helmet comprises a football helmet.

Clause 24: The helmet of clause 22 or clause 23, wherein the interior padding portion comprises at least one inflatable cushion.

Clause 25: The helmet of any of clauses 22-24, wherein the interior padding portion comprises a plurality of inflatable cushions fluidly connected together.

Clause 26: The helmet of clause 25, further comprising a nozzle extending through openings in the outer shell and the inner shell for filling each of the plurality of inflatable cushions of the interior padding portion through the nozzle.

Clause 27: A football helmet comprising: a shell portion comprising: an outer shell; an inner shell spaced apart from the outer shell, the inner shell and the outer shell defining an interior space; at least one fastener assembly extending from the outer shell to the inner shell through the interior space; and at least one inflated bladder positioned in the interior space defined by the inner shell and the outer shell; a strap connected to the inner shell for securing the helmet to a head of a wearer; and a face mask connected to the outer shell positioned to protect at least a portion of a face of the wearer.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

BRIEF DESCRIPTION OF THE DRAWINGS

FIG. 4A is a schematic drawing of the fastener assembly of the football helmet of FIG. 1 in a neutral position without any applied forces;

FIG. 4B is a schematic drawing showing effects of a radially directed impact force on the fastener assembly of FIG. 4A;

FIG. 4C is a schematic drawing showing effects of a torque or twisting force on the fastener assembly of FIG. 4A.

DETAILED DESCRIPTION

Figure 1:
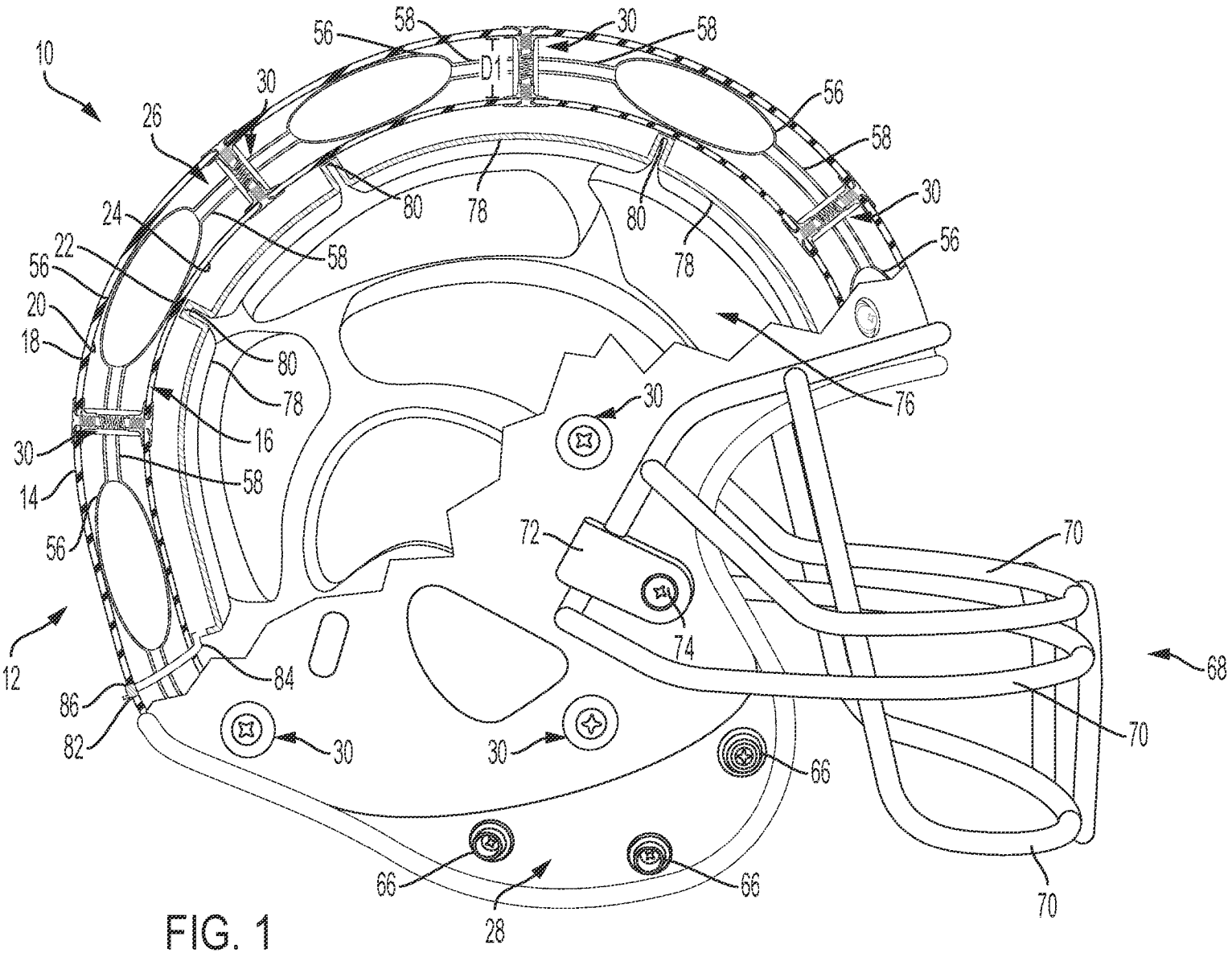
FIG. 1 is a cross section view of an example of a football helmet including aspects of the present disclosure.

For purposes of the description hereinafter, the terms "upper", "lower", "right", "left", "vertical", "horizontal", "top", "bottom", "lateral", "longitudinal," and derivatives thereof shall relate to the disclosure as it is oriented in the drawing figures. However, it is to be understood that the disclosure may assume various alternative variations, except where expressly specified to the contrary. It is also to be understood that the specific devices illustrated in the attached drawings, and described in the following specification, are simply exemplary embodiments of the disclosure. Hence, specific dimensions and other physical characteristics related to the embodiments disclosed herein are not to be considered as limiting.

For the purposes of this specification, unless otherwise indicated, all numbers expressing dimensions, physical characteristics, and so forth used in the specification and claims are to be understood as being modified in all instances by the term "about." Unless indicated to the contrary, the numerical parameters set forth in the following specification and attached claims are approximations that can vary depending upon the desired properties sought to be obtained by the present invention.

Notwithstanding that the numerical ranges and parameters setting forth the broad scope of the invention are approximations, the numerical values set forth in the specific examples are reported as precisely as possible. Any measured numerical value, however, may inherently contain certain errors resulting from the standard deviation found in their respective testing measurements.

Also, it should be understood that any numerical range recited herein is intended to include all sub-ranges subsumed therein. For example, a range of "1 to 10" is intended to include any and all sub-ranges between and including the recited minimum value of 1 and the recited maximum value of 10, that is, all subranges beginning with a minimum value equal to or greater than 1 and ending with a maximum value equal to or less than 10, and all subranges in between, e.g., 1 to 6.3, or 5.5 to 10, or 2.7 to 6.1.

Figure 2:
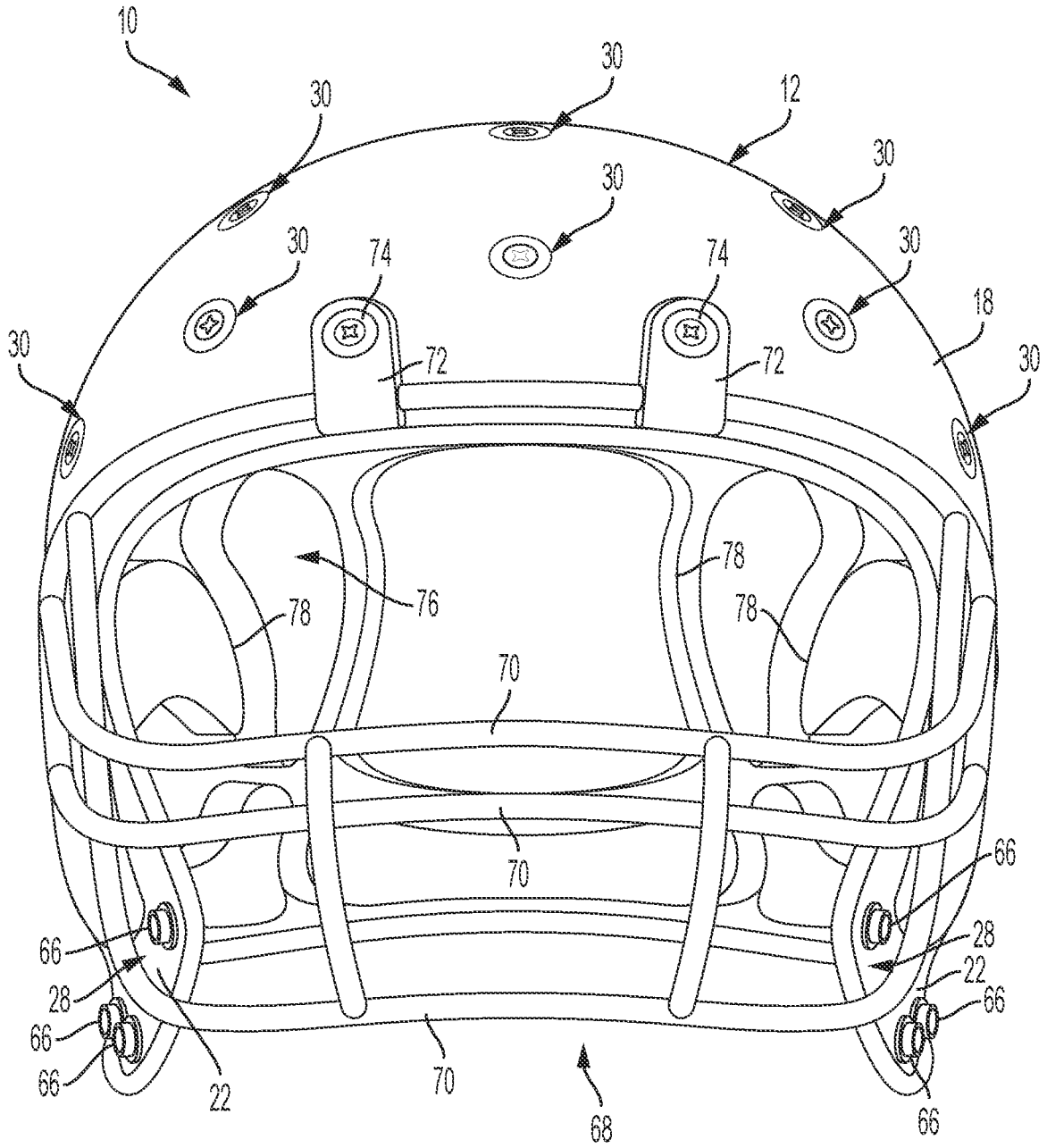
FIG. 2 is a front view of the football helmet of FIG. 1.
Figure 3:
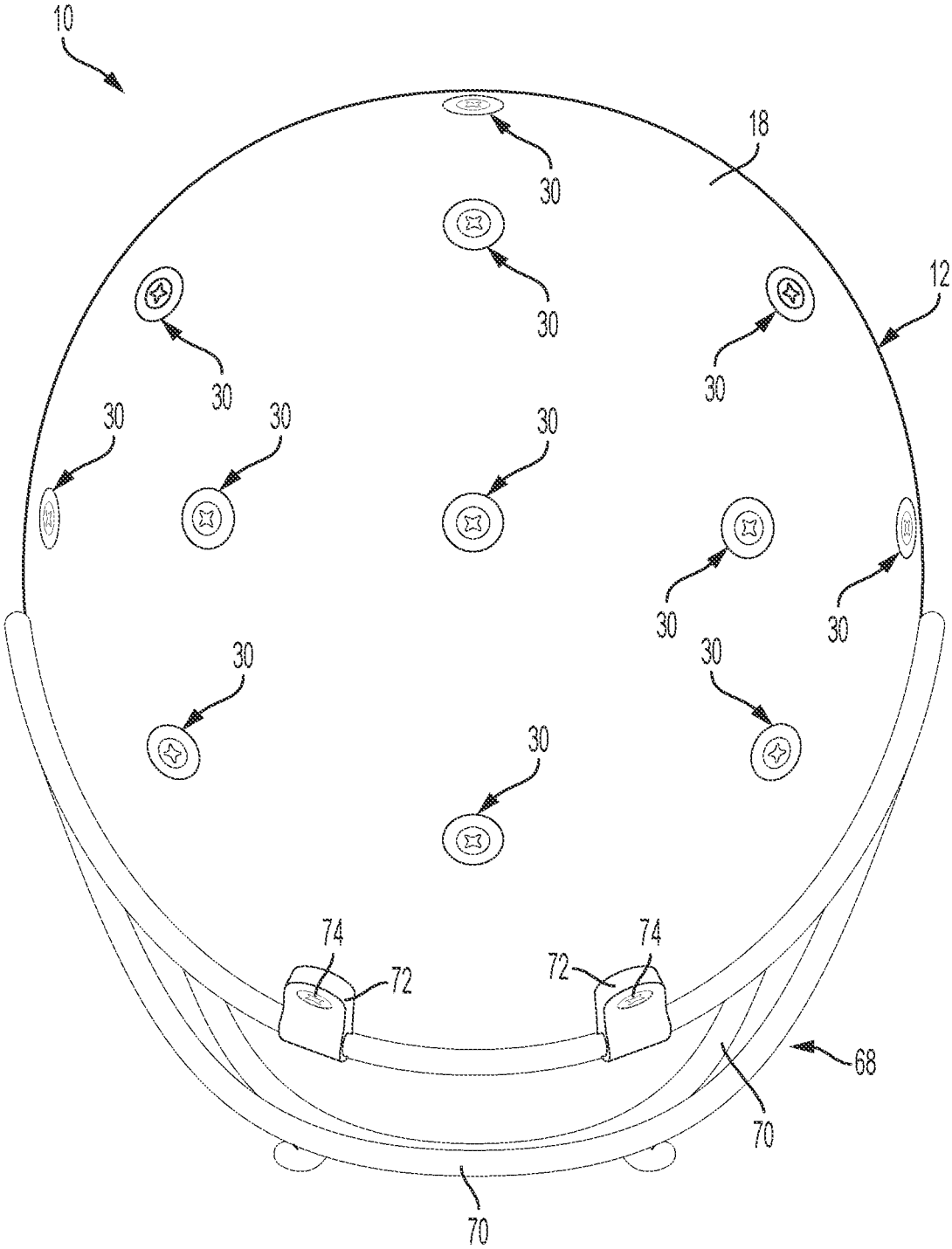
FIG. 3 is a top view of the football helmet of FIG. 1.

With reference to the figures, the present disclosure is directed to a helmet 10 designed to improve wearer safety by reducing risks of concussions, skull fractures, and other traumatic brain injuries. The helmet 10 shown in FIGS. 1-3 is a football helmet. However, the principles and designs disclosed herein can be adapted for use with helmets used for other sports and activities including, without limitation, hockey, lacrosse, baseball (e.g., batting helmets), vehicle racing (e.g., motorcycle, automobile, snowmobile, jet ski, boat, and/or bicycle racing), skiing, snowboarding, inline skating, and skateboarding. As described in detail herein, the helmet 10 comprises structures, such as rigid shells, inflated bladders, cushions, pads, and/or pillows for absorbing and/or distributing impact forces, such as forces caused by tackling and other collisions that occur during sports, vehicle crashes, and similar traumatic events.

In some examples, the helmet 10 is designed to be lightweight compared to currently available helmets. For example, portions of the helmet 10 may be formed from strong and lightweight materials such as carbon fiber or titanium, rather than heavier plastic and metal materials. Given the broad surface areas of contacting collisions during contact sports, composite carbon fiber materials are believed to provide for reduced weight and increased strength for resisting compressive forces compared to other metals or plastics. Also, portions of the helmet 10 can be formed from air-filed bladders rather than foams and gels, as are used in many presently available helmet designs. Reducing the weight of the helmet 10 is expected to make the helmet 10 more comfortable compared to currently available designs.

Substantially reducing the weight of the helmet 10 also reduces kinetic energy created by movement of the wearer's head. The present inventor has recognized that reducing kinetic energy of the moving helmet reduces impact forces on the wearer's head created when the helmet 10 contacts other objects, such as other players, other helmets, the ground or ice, or sporting equipment (e.g., goal posts, goals, hockey boards, etc.). Reducing intensity of impact forces is believed to decrease occurrences of events that cause sub-concussive injuries, concussions, skull fractures, and other head or brain injuries compared to currently available helmet designs.

More specifically, the "kinetic energy" of an object is the work needed to accelerate a body of a given mass m from rest to a stated velocity v. Kinetic energy KE is reflected in the classical physics equation as $KE=\frac{1}{2}mv^2$, where m is mass and v is velocity. The same amount of work or force is required to decelerate the object from its given speed to a state of rest. In Newtonian mechanics, momentum p of an object is a product of the mass m and the velocity v (e.g., $p=mv$). The velocity has a vector component. The momentum p of a movable object must be conserved by other forces, as shown, for example, when momentum of a pool cue ball is transferred to other rack pool balls after a collision. Common to both kinetic energy KE and momentum p is the need for equal opposing forces to be applied to the object to decelerate and/or arrest movement of the object. In the case of a human head covered by a protective device (e.g., a helmet), the one variable that can be controlled to affect both kinetic energy KE and momentum p is mass m. Since both velocity v and human head mass can be variable, the present inventor has recognized that the only component that can be manipulated is the mass m of the protective device or helmet itself. Further, the present inventor has recognized that the laws of physics indicate that collision forces transmitted to the helmeted head after collision or deceleration can be reduced by providing a lightweight helmet, such as the lightweight dual-shell helmet 10 disclosed herein.

An improved football helmet 10 including aspects of the present disclosure is shown in FIGS. 1-3. The helmet 10 comprises a shell portion 12 comprising an outer shell 14 and an inner shell 16. The outer shell 14 comprises an outwardly facing surface 18 and an opposing inwardly facing surface 20. The inner shell 16 also comprises an outwardly facing surface 22, which faces the inwardly facing surface 20 of the outer shell 14, and an opposing inwardly facing surface 24. The inner shell 16 is spaced apart from the outer shell 14 by a distance D1 defining an interior space or region 26 between the outer shell 14 and the inner shell 16. In some examples, the outer shell 14 and the inner shell 16 are about the same shape and size, such that all portions of the outer shell 14 overlap with or cover corresponding portions of the inner shell 16. In other examples, the inner shell 16 may include portions that are not covered or overlapped by the outer shell 14. For example, as shown in FIG. 1, a portion of the inner shell 16 near the wearer's ears, shown generally be reference number 28, is not covered by the outer shell 14.

As used herein, a "shell" refers to a structure formed from a substantially rigid sheet, which is molded, bent, or otherwise formed into a three-dimensional curved shape generally conforming to a size and shape of a wearer's head. For example, the curved shape may be sized to extend from approximately the wearer's forehead, over the crown of the head, and towards the occipital portion of the head near the base of the skull. The curved shape may also include portions that extend towards or over the wearer's ears.

The shells 14, 16 can be formed from different rigid materials that are capable of absorbing impact forces without breaking. Suitable shells 14, 16 can be formed, for example, from composite carbon fibers or lightweight metals, such as titanium. Portions of the shells 14, 16 may also be formed from heavier polymer materials, such as polycarbonate. The shells 14, 16 can be formed from a single molded or cast layer. Alternatively, the shells 14, 16 can be formed from multiple layers (e.g., multiple polymer or carbon fiber layers) laminated together to form a suitably strong structure.

The shell portion 12 of the helmet 10 further comprises a plurality of fastener assemblies 30 extending between the outer shell 14 to the inner shell 16. The fastener assemblies 30 can be configured to support and maintain separation between the shells 14, 16. The fastener assemblies 30 may also be configured to absorb impact forces (e.g., forces on the outer shell 14 directed radially inward toward the wearer's head), as well as various twisting or torque forces caused by movement of the shells 14, 16 relative to one another. The fastener assemblies 30 can be positioned at any convenient position on the inner and outer shells 14, 16. For example, fastener assemblies 30 can be aligned in rows, columns, or in any other convenient pattern. Also, the fastener assemblies 30 may be arranged to create different designs to contribute to the aesthetic appearance of the helmet 10. In some examples, the helmet 10 comprises about ten to about fifteen fastener assemblies 30, though the number of fastener assemblies may be more or less depending on the size of the helmet 10 and/or anticipated intensity of impact forces to which the helmet 10 will be exposed. As shown in FIG. 3, the exemplary helmet 10 comprises twelve fastener assemblies 30; however, the number and positioning of fastener assemblies 30 shown in FIG. 3 is not intended to limit the scope of the present disclosure.

As shown in FIGS. 4A-4C, the fastener assemblies 30 each comprise an inner fastener 32 inserted through an opening 34 in the inner shell 16, an outer fastener 36 inserted through an opening 38 in the outer shell 14, and a resilient member 40 extending between an end portion 32*b* of the inner fastener 32 and an end portion 36*b* of the outer fastener 36. As shown in FIG. 4A, the fasteners 32, 36 do not contact each other when the fastener assembly 30 is in an unbiased position. Thus, a length L1 of the fasteners 32, 36 is less than half of the distance D1 between the outer shell 14 and the inner shell 16. The fastener 32, 36 can be a screw, pin, rod, or similar fixation member configured to partially maintain positioning of the inner shell 14 relative to the outer shell 16.

The resilient member 40 extending between the inner fastener 32 and the outer fastener 36 is configured to permit the shells 14, 16 to move slightly relative to one another. When the fastener assembly 30 is an unbiased state (shown in FIG. 4A), with no applied external forces, the resilient member 40 can have an unbiased length L2 (shown in FIG. 4A). As shown schematically in FIG. 4B, when a radially directed impact force (shown by arrow A1) is exerted on the outer shell 14, the resilient member 40 compresses to at least partially absorb the impact force to a compressed length L3. Compression of the resilient member 40 reduces the distance D1 between the inwardly facing surface 20 of the outer shell 14 and the outwardly facing surface 22 of the inner shell 16. In contrast, when a torque or twisting force (shown by arrow A2 in FIG. 4C) is applied to the outer shell 14, the resilient member 40 bends or flexes, allowing the outer shell 14 to move or slide relative to the inner shell 16, thereby absorbing the applied torque force A2 so that the applied force is not transferred directly to other portions of the helmet 10 and/or directly to the wearer's head.

As shown in FIGS. 4A-4C, the resilient member 40 can be a spring, such as a helical spring formed from metal. In other examples, the resilient member 40 can comprise a flexible tube or cylindrical member that is capable of deforming (e.g., compressing, extending, or bending) in response to applied forces. In some examples, the resilient member 40 is a tubular or hollow member having open ends, so that the end portions 32*b*, 36*b* of the fasteners 32, 36 can be inserted into the open ends of the resilient member 40.

In some examples, the fastener assemblies 30 further comprise annular collars 42, 44, 46, 48 positioned through or adjacent to the openings 34, 38 in the inner and outer shells 14, 16 for supporting and/or anchoring the fasteners 32, 36 to the shells 14, 16. The annular collars 42, 44, 46, 48 can comprise a body portion 43 sized to receive the fasteners 32, 36 and an annular flange portion 45 extending therefrom positioned, for example, to contact surfaces of the outer shell 14 or the inner shell 16. The annular collars 42, 44, 46, 48 can be formed from metals or rigid plastics. The annular collars 42, 44, 46, 48 can be threaded to engage corresponding threads on the fasteners. As shown in FIGS. 4A-4C, in some examples, the fastener assembly 30 comprises a first outer annular collar 42 contacting the outwardly facing surface 18 of the outer shell 14, a second outer annular collar 44 contacting the inwardly facing surface 20 of the outer shell 14, a first inner annular collar 46 contacting the inwardly facing surface 24 of the inner shell 16, and a second inner annular collar 48 contacting the outwardly facing surface 22 of the inner shell 16. The inner fastener 32 is inserted through the first and second inner annular collars 46, 48, and the outer fastener 36 is inserted through the first and second outer annular collars 42, 44.

In some examples, the fastener assemblies 30 further comprise a sleeve 54 extending around portions of the collars 42, 44, 46, 48, fasteners 32, 36, and the resilient member 40. The sleeve 54 can be configured to provide additional support for the fasteners 32, 36 and the resilient member 40 and, in particular, to absorb impact forces applied to the shells 14, 16 of the helmet 10. The sleeve 54 is generally formed from a flexible material, such as an elastomeric polymer (e.g., silicone or natural and/or synthetic rubber). In some examples, the sleeve 54 is a generally tubular structure having a length L4, in an unbiased state (shown in FIG. 4A), corresponding to the length and diameter of the fasteners 32, 36 and the resilient member 40. Further, in the unbiased state (shown in FIG. 4A), the sleeve 54 has an inner diameter ID1 and an outer diameter OD1. In contrast, in the biased state (shown in FIG. 4B), the sleeve 54 has a length L5, an inner diameter ID2, and an outer diameter OD2. As shown by comparing FIG. 4A and FIG. 4B, the unbiased length L4 is longer than the biased length L5. The unbiased outer diameter OD1 is smaller than the biased diameter OD2. The inner diameters ID1, ID2 in the biased and unbiased state are about the same length.

With continued reference to FIGS. 1-3, in some examples, the shell portion 12 further comprises at least one inflated bladder 56 positioned in the interior region 26 between the outer shell 14 and the inner shell 16. The inflated bladder 56 is inflated by a fluid (e.g., a liquid, gas, and/or a gel) and configured to absorb forces applied to the shells 14, 16. The inflated bladder 56 can be formed from a flexible material capable of expanding to fill or substantially fill the interior region 26 between the outer shell 14 and the inner shell 16. For example, the inflatable bladder 56 can be formed from a stretchable elastomeric material, such as silicone. In some examples, the inflated bladder 56 is a fully sealed and enclosed structure that cannot be inflated or deflated once sealed and installed in the interior region 26 between the outer shell 14 and the inner shell 16. In other examples, the inflated bladder 56 can comprise and/or be fluidly connected to a nozzle or inflow port (not shown) for inflating or deflating the inflated bladder 56 to control and adjust how much the shell portion 12 deforms or flexes when exposed to impact forces.

In some examples, as shown in FIG. 1, the helmet 10 comprises multiple inflated bladders 56 positioned in the interior region 26 between the outer shell 14 and the inner shell 16. The multiple inflated bladders 56 can be connected by conduits or tubes 58 extending between the multiple inflated bladders 56, such that interiors of each of the inflated bladders 56 are fluidly connected together. Fluidly connecting the inflated bladders 56 together can simplify manufacture of the helmet 10, since the multiple inflated bladders 56 can be inflated simultaneously through a single port or opening. Also, the multiple inflated bladders 56 can be stronger and more resistant to breaking since only one port or opening is present and must be sealed after the bladders 56 are inflated. Further, interconnected inflated bladders 56 may be better able to absorb impact forces than individually sealed bladders 56, because as one bladder 56 compresses, air from the compressed bladder 56 is free to move through the conduits 58 to other bladders 56. In contrast, for a helmet 10 comprising multiple independent bladders 56, each bladder 56 is separately inflated and sealed, meaning that the bladder 56 may pop if an excessive impact force is applied to the shells 14, 16 of the helmet 10.

Figure 5:
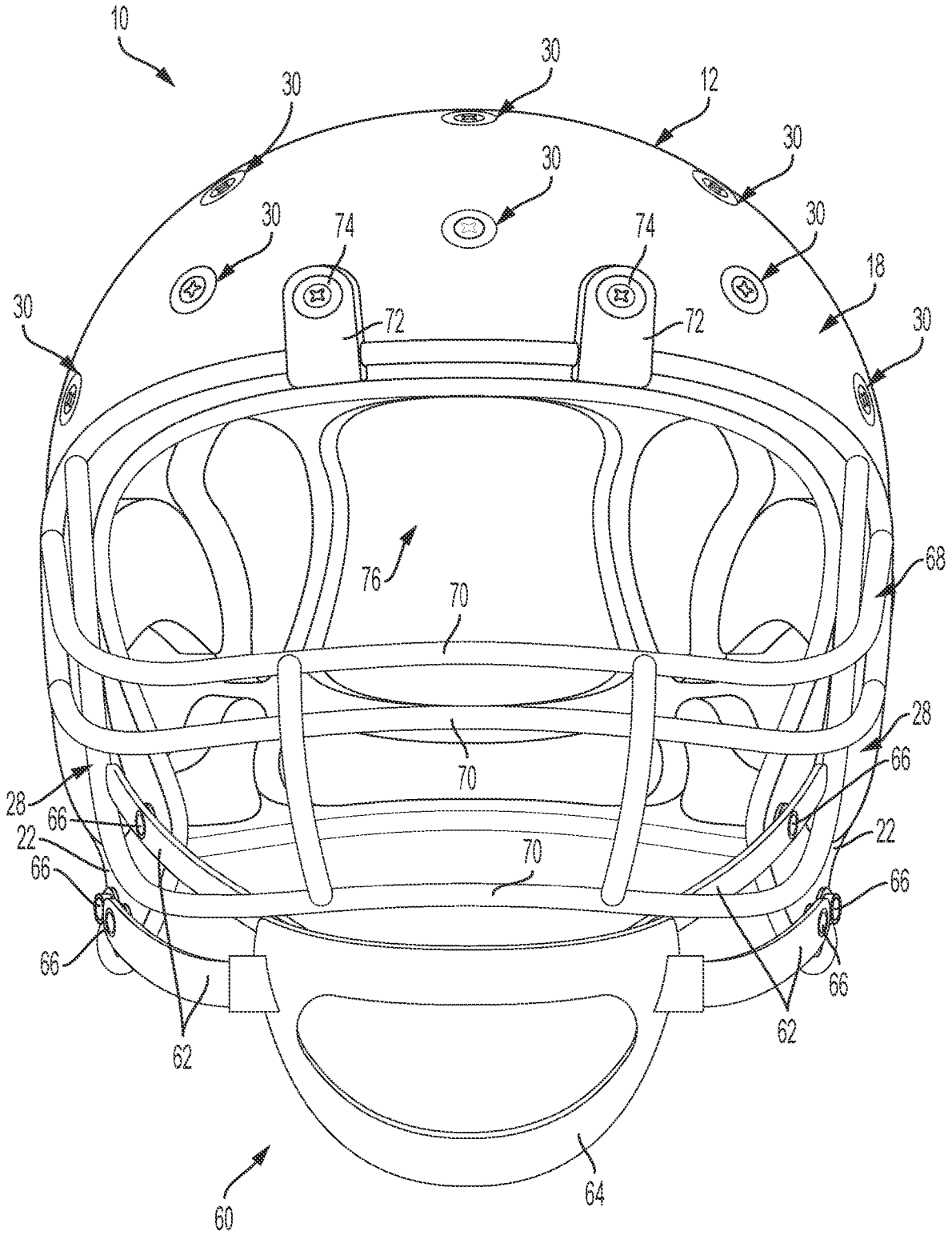
FIG. 5 is a front view of a football helmet including a chin strap, according to an aspect of the disclosure.

With reference to FIG. 5, in some examples, the helmet 10 further comprises a retention assembly or retention member 60. The retention assembly or retention member 60 can comprise a band, strap, rigid member (e.g., a chin bar), chain, or similar structure that secures the helmet 10 to the head of the wearer. For example, as shown in FIG. 5, the retention member 60 comprises a chin strap 62 extending across a bottom portion of the helmet 10 and configured to rest below the wearer's chin for securing the helmet 10 to the wearer's head. The chin strap 62 can include padding or covered portions to enhance comfort. In some examples, the chin strap 62 comprises a pocket portion 64 sized to receive the wearer's chin for increased comfort and security.

As shown in FIG. 5, the retention member 60 is connected to the outwardly facing surface 22 of the inner shell 16 of the helmet 10. Specifically, the retention member 60 is connected to the non-covered portion 28 of the inner shell 16, which forms the portion of the shell 16 covering the wearer's ears. In some examples, the retention member 60 (e.g., the chin strap 62) is secured to the inner shell 16 by connectors 66, such as snaps, fasteners, screws, or protrusions mounted to and/or extending from the outwardly facing surface 22 of the inner shell 16. In some examples, one end of the retention member 60, such as the chin strap 62, is fixed to the outwardly facing surface 22 of the inner shell 16 by a connector 66. An opposing end of the retention member 60 is removably connected to the inner shell 16 by a snap or similar connector 66, so that the retention member 60 can be detached when placing the helmet 10 on and removing the helmet 10 from the wearer's head.

By fixing the retention member 60 to the inner shell 16 (rather than to another portion of the helmet 10), any forces exerted on the retention member 60 are transferred to the inner shell 16. Since the fastener assemblies 30 are flexible and resilient, some of the force applied to the inner shell 16 is absorbed and is not transferred directly to other portions of the helmet 10, such as to the outer shell 14. Accordingly, the configuration of the retention member 60 and inner shell 16 is believed to improve force absorbing characteristics of the helmet 10.

With reference again to FIGS. 1-3, in some examples, the helmet 10 further comprises a face guard 68 or face guard assembly positioned to protect at least a portion of the wearer's face. As used herein, a "face guard" can refer to a member (e.g., a metal bar or rod), interconnected members, sheets, meshes, films, and combinations thereof, configured to cover and/or protect at least a portion of the wearer's face (e.g., to prevent objects from contacting one or more of the wearer's forehead, eyes, nose, mouth, chin, larynx, throat, and/or neck). In some examples, the face guard 68 comprises a substantially continuous sheet or shield positioned to prevent any objects from contacting the wearer's face. Alternatively, the face guard 68 can comprise or define openings (e.g., spaces between metal bars or rods), which allow smaller objects to pass through the face guard 68, while protecting the wearer's face from larger objects that are more likely to cause injury. In some examples, the face guard 68 can be a face mask formed from a plurality of connected vertical and/or horizontal bars 70 forming a mesh or cage structure covering all or at least a portion of the wearer's face. In other examples, the face guard 68 comprises a face shield, such as a shield formed from plastic (e.g., Plexiglas (poly(methyl methacrylate)), polycarbonate, and other acrylic polymer materials). The face shield can be formed from a substantially transparent material or a tinted material to reduce glare. In other examples, the face guard 68 can comprise googles, glasses, visors, or other structures commonly used for protecting portions of a wearer's face.

In some examples, the face guard 68 is connected to the outer shell 14 of the helmet 10 by fasteners, screws, brackets, and similar connectors as are known in the art. For example, as shown in FIGS. 1-3, the bars 70 of the face guard 68 are connected to the outwardly facing surface 18 of the outer shell 14 by a bracket 72, which is mounted to the outer shell 14 by a screw 74. Since the face guard 68 is fixed to the outer shell 14, any impact or torque forces applied to the face guard 68 (e.g., forces due to collisions with other objects and/or the ground or torque forces caused, for example, when another player grasps and twists the face guard 68) are transferred to the outer shell 14. Since the fastener assemblies 30 are flexible and absorb some applied forces, impact and torque forces applied to the face guard 68 are not transferred directly to other portions of the helmet 10 (e.g., to the inner shell 16 or the retention member 60). Accordingly, the possibility of injury from the impact and torque forces exerted on the face guard 68 is reduced compared to helmets that do not include structures for absorbing such impact and torque forces.

In some examples, the helmet 10 further comprises an interior padding portion 76 or liner that forms or defines an enclosure sized to receive the wearer's head. The interior padding portion 76 or liner is configured to be positioned between the inwardly facing surface 24 of the inner shell 16 and the wearer's head. In some examples, the interior padding portion 76 can be permanently fixed or attached to the inwardly facing surface 24 of the inner shell 16 by, for example, adhesives, tape, or mechanical fasteners. In other examples, the interior padding portion 76 or liner can be removably connected to the inwardly facing surface 24 of the inner shell 16 by, for example, fabric comprising a hook and loop fastening system (e.g., VELCRO®). In this way, the interior padding portion 76 or liner may be removed for cleaning and/or replaced with a different type of liner customized or specifically selected for a particular wearer.

The interior padding portion 76 is generally configured to absorb forces applied to the helmet 10 so that the applied forces are not transferred directly to the wearer's head. Also, the interior padding portion 76 can be configured to restrict movement of the wearer's head so that the head is not pressed against and/or does not contact the inwardly facing surface 24 of the inner shell 16 of the helmet 10 during impacts and collisions.

In some examples, as shown in FIG. 1, the interior padding portion 76 comprises one or more inflatable cushions 78 positioned to protect the wearer's head from contacting the inwardly facing surface 24 of the inner shell 16. An exemplary liner for a football helmet, which can be used with the helmet 10 of the present disclosure and which includes inflatable cushions 78 is described in U.S. Pat. No. 6,226,801, entitled "Football helmet having a removable inflatable liner and a method for making the same," which is incorporated by reference herein in its entirety.

Inflatable cushions 78 of the interior padding portion 76 can be positioned through the interior of the helmet 10 in a variety of patterns determined based on the intended use of the helmet 10 and/or expected location and intensity of impacts to the helmet 10. For example, as shown in FIG. 1, some of the inflatable cushions 78 can be positioned to contact and protect the crown of the wearer's head. Other inflatable cushions 78 can be positioned near the sides of the wearer's head (e.g., near to the wearer's ears or jaw). Alternatively or in addition to the inflatable cushions 78, the interior padding portion 76 can also comprise pads or cushions formed from soft cushioning materials that are not inflatable. For example, portions of the interior padding portion 76 can be formed from or comprise foams, gels, fabrics, and other cushioning materials arranged to provide appropriate support for portions of the wearer's head.

In some examples, the interior padding portion 76 comprises multiple inflatable cushions 78 connected together by tubes or conduits 80, so that the multiple inflatable cushions 76 can be inflated from a single inflow port or nozzle, such as the nozzle 82 shown in FIG. 1. As shown in FIG. 1, the nozzle 82 extends from one of the inflatable cushions 78 through an opening 84 in the inner shell 16 and an opening 86 the outer shell 14. The nozzle 82 is configured to either protrude slightly from the opening 86 in the outer shell 14 (as shown in FIG. 1) or to be slightly recessed and accessible through the opening 86 in the outer shell 14. Since the nozzle 82 protrudes or is accessible through the opening 86 in the outer shell 14, the inflatable cushions 78 can be inflated while the wearer is wearing the helmet 10. This allows for a user (e.g., the wearer or, for example, a team equipment manager) to inflate the interior cushions 78 while the helmet 10 is in place on the wearer's head until the wearer confirms that the helmet 10 is secure and comfortable.

Pump systems for inflating an interior liner of football helmets are known. For example, U.S. Pat. Nos. 9,661,890; 9,868,046; and 10,004,973, which are entitled "Automated helmet gas bladder maintenance system and method," and which are incorporated herein by reference in their entireties, discloses a pump operated by a portable electronic device (e.g., a smart phone) that can be programmed to inflate an inflatable liner of a helmet to a predetermined preferred inflation pressure for each player. The predetermined inflation pressure may be determined during initial testing or customization of a player's helmet. Once the predetermined pressure is known for a player, the inflation level for a helmet can be periodically tested and inflated or deflated as needed.

Although the disclosure has been described in detail for the purpose of illustration based on what is currently considered to be the most practical and preferred embodiments, it is to be understood that such detail is solely for that purpose and that this disclosure is not limited to the disclosed embodiments, but, on the contrary, is intended to cover modifications and equivalent arrangements. Furthermore, it is to be understood that the present disclosure contemplates that, to the extent possible, one or more features of any embodiment can be combined with one or more features of any other embodiment.

What is claimed is:

1. A helmet comprising:

a shell portion comprising:

a rigid outer shell;

a rigid inner shell spaced apart from the outer shell, the inner shell and the outer shell defining an interior space between the inner shell and the outer shell;

a plurality of fastener assemblies extending from the outer shell to the inner shell through the interior space, each of the plurality of fastener assemblies comprising an inner fastener inserted through an opening in the inner shell, an outer fastener separate from the inner fastener and inserted through an opening in the outer shell, a resilient member extending between an end portion of the inner fastener and an end portion of the outer fastener, and a sleeve comprising an elastomeric material extending around the inner fastener, the outer fastener, and the resilient member; and at least one inflated bladder positioned in the interior space defined by the inner shell and the outer shell;

a retention assembly directly connected to the inner shell for securing the helmet to a head of a wearer; and a face guard assembly directly connected to the outer shell positioned to protect at least a portion of a face of the wearer and configured so that impact or torque forces applied to the face guard assembly are transferred directly to the outer shell and transferred to the inner shell through the plurality of fastener assemblies.

2. The helmet of claim 1, wherein the helmet comprises a football helmet.

3. The helmet of claim 1, wherein the retention assembly comprises a chin strap.

4. The helmet of claim 1, further comprising a snap connector directly connected to an outwardly facing surface of the inner shell, wherein the retention assembly is fixedly connected to the outwardly facing surface of the inner shell by the snap connector.

5. The helmet of claim 1, wherein the face guard assembly comprises at least one of a mask, a shield, a cage, or a crossbar.

6. The helmet of claim 1, further comprising at least one fastener for fixedly connecting the face guard assembly to an outwardly facing surface of the outer shell.

7. The helmet of claim 1, wherein the inner shell comprises at least one of polycarbonate, a composite of carbon fiber material, or a combination thereof.

8. The helmet of claim 1, wherein the inner shell and the outer shell comprise a composite carbon fiber material.

9. The helmet of claim 1, wherein the plurality of fastener assemblies each further comprise:

at least one inner annular collar connected to and at least partially disposed within the opening of the inner shell for supporting the inner fastener, and at least one outer annular collar connected and at least partially disposed within the opening of the outer shell for supporting the outer fastener, wherein the at least one inner annular collar and the at least one outer annular collar each comprise a body portion configured to receive one of the inner fastener or the outer fastener and a flange portion extending about the body portion.

10. The helmet of claim 1, wherein the plurality of fastener assemblies each further comprise:

a first outer annular collar connected to an outwardly facing surface of the outer shell and at least partially disposed within the opening of the outer shell, a second outer annular collar connected to an inwardly facing surface of the outer shell, the second annular outer collar comprising an annular flange portion contacting the inwardly facing surface of the outer shell and a body portion comprising interior threads that engage the outer fastener, a first inner annular collar connected to an inwardly facing surface of the inner shell and at least partially disposed within the opening of the inner shell, and a second inner annular collar connected to an outwardly facing surface of the inner shell, the second annular inner collar comprising an annular flange portion contacting the outwardly facing surface of the inner shell and a body portion comprising interior threads that engage the inner fastener.

11. The helmet of claim 10, wherein the inner fasteners of the plurality of fastener assemblies are inserted through openings defined by the first and second inner annular collars, and the outer fasteners of the plurality of fastener assemblies are inserted through openings defined by the first and second outer annular collars.

12. The helmet of claim 1, wherein the inner fasteners of the plurality of fastener assemblies each comprise an inner screw and the outer fasteners of the plurality of fastener assemblies each comprise an outer screw, and wherein the resilient members comprise a coil spring with the inner screw and/or the outer screw at least partially disposed within an interior space defined by the coil spring.

13. The helmet of claim 1, wherein the at least one inflated bladder comprises a plurality of inflated bladders connected by tubular conduits.

14. The helmet of claim 1, further comprising an interior padding portion connected to and extending from an inwardly facing surface of the inner shell, the interior padding portion defining an enclosure for receiving at least a portion of the wearer's head, wherein the interior padding portion comprises a plurality of inflatable cushions fluidly connected together and the helmet further comprises a nozzle extending through openings in the outer shell and the inner shell for filling each of the plurality of inflatable cushions of the interior padding portion through the nozzle.

15. A helmet comprising:

a shell portion comprising:

a rigid outer shell comprising carbon fiber configured to be positioned over a head of a wearer and configured to extend over a crown of the head and over ears of the wearer;

a rigid inner shell comprising carbon fiber and also configured to be positioned over the head of the wearer and configured to extend over the crown of the head and over the ears of the wearer, wherein the inner shell is spaced apart from the outer shell, the inner shell and the outer shell defining an interior space between the inner shell and the outer shell;

a plurality of fastener assemblies extending from the outer shell to the inner shell through the interior space, each of the plurality of fastener assemblies comprising an inner fastener inserted through an opening in the inner shell, an outer fastener separate from the inner fastener and inserted through an opening in the outer shell, a resilient member extending between an end portion of the inner fastener and an end portion of the outer fastener, and a sleeve comprising an elastomeric material extending around the inner fastener, the outer fastener, and the resilient member; and at least one inflated bladder positioned in the interior space defined by the inner shell and the outer shell; and an interior padding portion connected to and extending from an inwardly facing surface of the inner shell, the interior padding portion defining an enclosure for receiving at least a portion of the head of the wearer.

16. The helmet of claim 15, wherein the helmet comprises a football helmet.

17. The helmet of claim 15, wherein the interior padding portion comprises a plurality of inflatable cushions fluidly connected together, the helmet further comprising a nozzle extending through openings in the outer shell and the inner shell for filling each of the plurality of inflatable cushions of the interior padding portion through the nozzle.

18. A football helmet comprising:

a shell portion comprising:

a rigid outer shell;

a rigid inner shell spaced apart from the outer shell, the inner shell and the outer shell defining an interior space;

a plurality of fastener assemblies extending from the outer shell to the inner shell through the interior space, each of the plurality of fastener assemblies comprising an inner fastener inserted through an opening in the inner shell, an outer fastener separate from the inner fastener and inserted through an opening in the outer shell, a resilient member extending between an end portion of the inner fastener and an end portion of the outer fastener, and a sleeve comprising an elastomeric material extending around the inner fastener, the outer fastener, and the resilient member; and at least one inflated bladder positioned in the interior space defined by the inner shell and the outer shell;

a strap directly connected to the inner shell for securing the helmet to a head of a wearer; and a face mask directly connected to the outer shell positioned to protect at least a portion of a face of the wearer configured so that impact or torque forces applied to the face mask are transferred directly to the outer shell and transferred to the inner shell through the plurality of fastener assemblies.

19. The helmet of claim 1, wherein the retention assembly is directly connected to the inner shell, such that torque or impact forces applied to the retention assembly are transferred directly to the inner shell and transferred to the outer shell through the plurality of fastener assemblies.

20. The helmet of claim 1, wherein the impact or torque forces applied to the face guard assembly are only transferred to the inner shell through the plurality of fastener assemblies.

21. The helmet of claim 1, wherein the impact or torque forces applied to the face guard assembly are not transferred directly to the inner shell.

* * * * *